US008962099B2

(12) United States Patent
Dubreuil et al.

(10) Patent No.: US 8,962,099 B2
(45) Date of Patent: Feb. 24, 2015

(54) PLASMA SURFACE ACTIVATION METHOD AND RESULTING OBJECT

(71) Applicant: Vlaamse Instelling Voor Technologisch Onderzoek (VITO), Mol (BE)

(72) Inventors: Marjorie Dubreuil, Lummen (BE); Bert Verheyde, Hasselt (BE)

(73) Assignee: Vlaamse Instelling voor Technologisch Onderzoek (VITO), Mol (BE)

( * ) Notice: Subject to any disclaimer, the term of this patent is extended or adjusted under 35 U.S.C. 154(b) by 85 days.

(21) Appl. No.: 13/670,231

(22) Filed: Nov. 6, 2012

(65) Prior Publication Data

US 2013/0112347 A1 May 9, 2013

(30) Foreign Application Priority Data

Nov. 7, 2011 (EP) ..... 11188110

(51) Int. Cl.
*H05H 1/24* (2006.01)
*B05D 1/00* (2006.01)

(52) U.S. Cl.
CPC ..... *B05D 1/62* (2013.01)
USPC ..... 427/569

(58) Field of Classification Search
CPC ..... B05D 1/62; B05D 5/04; B05D 7/24; B05D 7/50; B05D 7/52; B05D 2201/02; B05D 2202/00; B05D 2203/20; B05D 2203/22; B05D 2203/30; B05D 2203/35; B05D 2252/00; B05D 2256/00; B05D 2401/31
USPC ..... 427/569
See application file for complete search history.

(56) References Cited

U.S. PATENT DOCUMENTS

2010/0028561 A1* 2/2010 Dubreuil et al. ..... 427/572

FOREIGN PATENT DOCUMENTS

EP 1 095 711 A2 5/2001
WO WO 2005089957 A1 * 9/2005

OTHER PUBLICATIONS

Merriam-Webster's Collegiate Dictionary, tenth edition, p. 1346.*
D. Holter, et al., "Degree of branching in hyperbranched polymers", Acta Polymer, 1997, pp. 30-35, vol. 48, No. 1-2.
Partial European Search Report for EP 11 18 8110, dated Jul. 23, 2012.

* cited by examiner

*Primary Examiner* — Elena T Lightfoot
(74) *Attorney, Agent, or Firm* — Sughrue Mion, PLLC

(57) ABSTRACT

A method for depositing functional groups on a surface of an object, and to the object treated as such, by generating and maintaining a plasma, bringing the object surface close to or in a space between the plasma electrodes, an atmosphere being present between the two electrodes, and depositing a plurality of functional groups on at least part of the surface of the object, wherein the atmosphere between the two electrodes comprises a multi-functional hyperbranched compound which is a polymer based on $AB_m$ type monomers, or a derivative of such polymer, wherein m is at least 2, A and B have reactive functional groups selected such that group A is reacted at least m times with group B, and the hyperbranched compound has a degree of branching (DB) in the range of 10.0-99.9%.

21 Claims, 1 Drawing Sheet

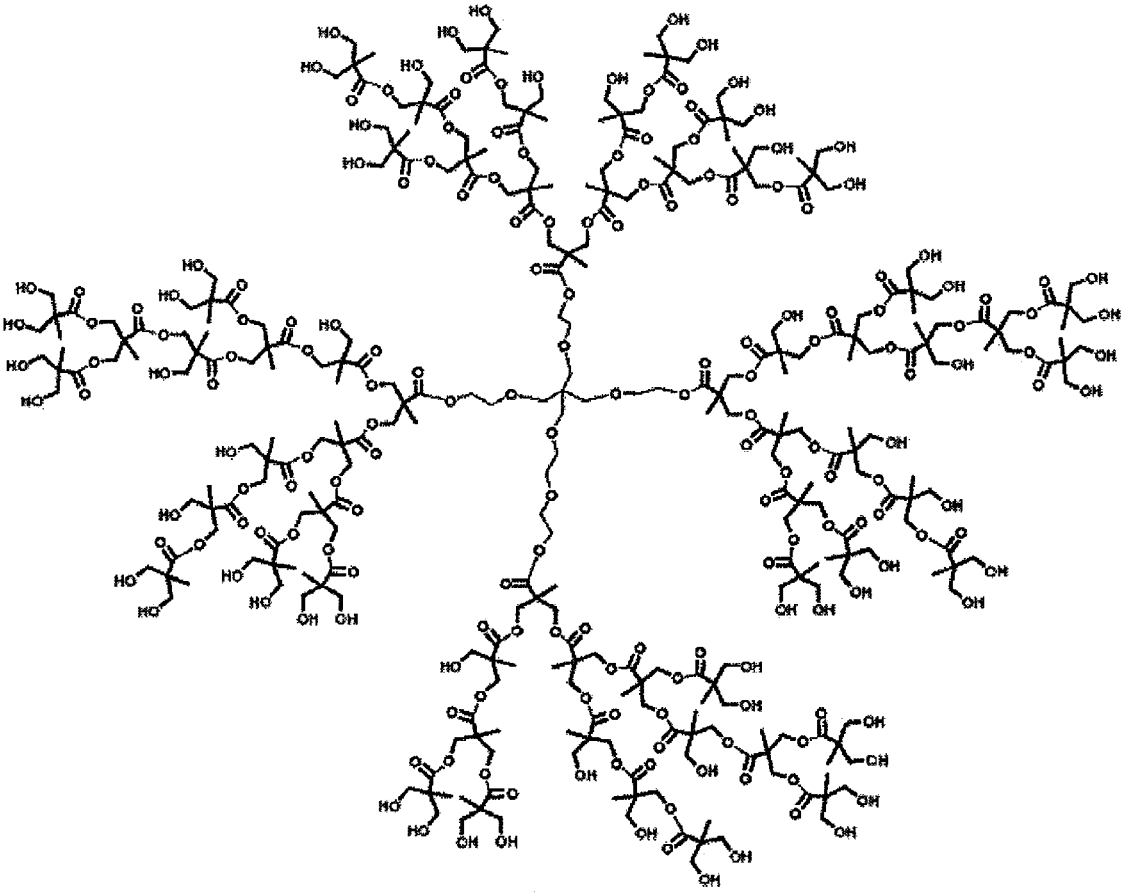

PLASMA SURFACE ACTIVATION METHOD AND RESULTING OBJECT

FIELD OF THE INVENTION

The present invention relates to plasma techniques, involving the deposition of functional groups onto any type of solid surface. More particularly, the invention relates to the use of multi-functional hyperbranched oligomers and/or polymers for that purpose.

BACKGROUND OF THE INVENTION

The desire to treat surfaces has been as old as mankind. These desires may be inspired by changing a variety of surface properties, ranging from the aesthetic over the physical to the chemical properties.

In many applications the mechanical, chemical or physical properties of surfaces of materials play an important role. If, for any reason, the requirements can not be met by the bulk of the material, the application of coatings and surface modification is a convenient method in order to improve the properties. In this way many substrates can be refined and used in new applications. A very simple case is the refinement by coating with decorative and coloured layers.

Also from an industrial point of view, there is an increasing interest to control the surface functionality and the surface properties of all kinds of substrates. More and more demands arise for controlling for example adhesion and release properties of different substrates, more specifically of polymer substrates. These properties are often linked to the hydrophobic or hydrophilic character of the surface. Others may be interested in making surfaces oil or water repellent, for instance of fabrics but also of metal, glass, ceramics, paper, or polymerics, for purposes such as improving preservation properties, or to prevent or inhibit soiling of the surfaces.

Conventional methods for the modification of surface properties involve the use of wet chemical deposition of coatings on a given substrate, often commonly called "painting". However, most of the time solvents have to be used as the basis for the paint, for carrying the chemicals which must form the coating onto the surface. This has led to increased costs, industrial health and environmental issues because of the volatility of the solvents, which are contributing to problems such as sick-building-syndrome because of the emission of volatile organic compounds (VOC) into the atmosphere. For those reasons, paints based on organic solvents have found more and more substitution by water-based paints. This has been able to reduce the problem but has not necessarily been able to avoid all VOC emissions. There has therefore remained a need for improved means for modifying the properties of various surfaces.

Standard industrial coating technologies now may comprise the application of a lacquer followed by thermal or UV-induced curing treatment.

Techniques involving vacuum have also been developed, such as chemical vapor deposition (CVD), physical vapor deposition (PVD), and low pressure plasma techniques.

A widely used method for surface modification of a polymer is corona treatment at atmospheric pressure. The drawback however is that this technique produces inhomogeneous surface changes and that the changes are not stable in time. Corona treatment may optionally be combined with a wet chemical deposition.

WO2005/089957 describes the use of atmospheric pressure plasma for the pretreatment of a given substrate, after which a solvent containing reactive solution is applied to form a stable coating after solvent removal.

Another commonly used method for the modification of surface properties of a substrate and/or to produce coatings on a substrate is to submit the substrate to a low pressure plasma treatment. In particular, it is known to use a polymer forming precursor, which may also be called a monomer, as the coating forming material, and to introduce said precursor into a plasma discharge, whereby polymerization takes place to form a polymer coating on the substrate.

WO 2007/053916 describes an improvement of this technique wherein a doping or dedoping agent is added as second component into the plasma containing a conjugated polymer forming precursor such as thiophene or a derivative thereof. The second component may be an inorganic or mixed organic/inorganic precursor so that a hybrid organic/inorganic coating is formed.

WO00/032248 describes the enhancement of the surface properties of polymers for medical applications using low pressure plasma in the presence of various gaseous precursors or hydrocarbons.

US2004/258931 describes the plasma cross-linking at low pressure of a double bond containing monomer on a hydrophilic polymeric layer deposited on the substrate to enhance the hydrophilicity of medical devices.

WO95/04609 describes the deposition of a hydrophilic coating on a lens by low-pressure plasma technology using a carrier gas comprising hydrogen peroxide and at least one functional organic compound.

However, low-pressure plasma has the disadvantage of requiring very complex and thus highly cost-ineffective reactors and therefore large investments for industrializing the process. In addition, low-pressure plasma processes are generally batch processes which are very difficult to integrate into existing continuous production facilities.

Recent developments in the field of atmospheric plasma technology are creating new perspectives beyond current state of the art in corona pretreatment of materials. By controlling the gas atmosphere and electrical conditions, one may increase the efficiency of the plasma surface treatment significantly. Furthermore, by adding reactive chemical precursors to the plasma discharge, the surface chemistry may be controlled and thin functional coatings may be deposited. In document "Production and deposition of adsorbent films by plasma polymerization on low cost micromachined non-planar microchannels for preconcentration of organic compound in air", by Lima et al, Sensors and Actuators, vol. 108, nr 1-2 (2005), a plasma deposition of ethyl acetate is described, resulting in a hydrophilic film.

Plasma grafting may also be employed to enhance the surface hydrophilicity of polymers. It is usually conducted by first exposing a polymer to a plasma such as argon, helium, or nitrogen, for a short time, typically a few seconds. This part of the process introduces many radicals to the surface of the polymer. Afterwards, the polymer substrate is brought into contact with the vapour of a monomer or with air. However, in this case, the improved properties are not necessarily stable in time, and the substrate tends to come back rather quickly to its original state.

Advantages of the ambient pressure methods are that they may be used with standard and inexpensive coating and curing equipment. Vacuum methods are often associated with higher complexity equipment, and thus with additional costs concerning equipment and processing. Therefore, in metallisation processes and coating of small and high value substrates, e.g. ophthalmic lenses, the vacuum methods have been found to be successful.

In many cases and for special applications also other functional properties may have to be improved, e.g. hardness, chemical resistance, electrical resistivity, barrier properties or optical appearance.

EP 1557489 describes how the surface of a polymeric substrate or glass is made water and/or oil repellent by exposing the surface to a plasma comprising a perfluoroalkene or polyfluoroacrylate vapour, and causing plasma polymerization onto the surface.

WO 2005/095007 A1 discloses that hybrid organic/inorganic hybrid pre-polymers, formed via sol-gel processing, may also be added to the plasma discharge. This simple plasma-curing technique leads to additional cross-linking in the coating as compared to previously known techniques.

WO 2009/037331 A1 describes how a substrate surface may be given a stable hydrophilic coating by treatment in an atmospheric plasma into which ethyl acetate is injected in the form of an aerosol.

WO 2007/021180 discloses the growing of highly branched polymers called "polymer brushes" with a high density onto a surface which may have been activated using chemisorption reactions, using the "grafting to" technique by contacting the activated surface with polymer chains in the form of a melt.

In EP 1095711 A2 this technique is refined by first plasma coating the surface with 1,2-Diaminocyclohexane such that the surface is provided with polymer brushes having amino functions. These are then used to bind a polymerization initiator, which then allows graft polymerization of ethylenically unsaturated hydrophilic monomers or macromonomers onto the surface, such that the treated surface has an improved wettability, water retention ability and biocompatibility.

WO 03/086031 discloses an atmospheric plasma process comprising the spraying of liquid precursors in a plasma causing polymerization.

WO 2006/053403 A2 discloses a method for the immobilization of chitosan on a surface, substantially resistant to leaching and having strong microbial activity. The biaxially oriented polypropylene polymeric surface was activated before addition of chitosan to the surface by a surface plasma-activation at atmospheric pressure.

WO 2005/106477 discloses a method for the inclusion and immobilisation of biological molecules into a thin plasma polymerized and deposited coating layer using a single step process, with the purpose of obtaining bio-engineered materials having bio-recognition sites which may still interact with other species of interest, including biological species, and which may be useful in a wide range of applications. WO 2005/106477 is concerned with keeping the biological functionality of the bound biomolecules intact.

Boulares-Pender, A. et al, in "Surface-Functionalization of Plasma-Treated Polystyrene by Hyperbranched Polymers and Use in Biological Applications", Journal of Applied Polymer Science, Vol. 112, 2701-2709 (2009), Wiley Periodicals, Inc, disclose a method to increase the functionality density of a surface by in-situ growing or building of hyperbranched structures from a nitrogen plasma-exposed polystyrene (PS) surface, which may have reacted with atmospheric oxygen after plasma treatment. The plasma-exposed PS surfaces showed an increase of their wettability due to the formation of polar functional groups, as evidenced by contact angle measurements. The subsequent building of hyperbranched structures used 2-aminoethyl methacrylate hydrochloride (AEMA), glutaraldehyde (GA) and tetra-ethylene pentamine (TEPA) and built up to three generations of GA-TEPA segments on the surface. The advantage is that any biomolecules later on being attached to the surface are more likely to find a higher number of anchor points on the hyperbranched segments grown onto the PS surface. This method involves several process steps, and is therefore rather complex.

The density of the functional groups on the surfaces obtained with these known processes may remain however limited, and also the number of points with which the molecule fractions containing the functional groups are attached to the surface may remain limited, so that the obtained surface properties and the stability of these properties over time remain short of what may be desired.

There therefore remains a need for a simple technique which is able to deposit functional groups on a surface with a high density, such that the surface properties and the stability of these properties over time are improved as compared to what may be obtained with the so-far known techniques.

The present invention aims to obviate or at least mitigate the above described problems and/or to provide improvements generally.

SUMMARY OF THE INVENTION

According to the invention, there is provided a method for depositing functional groups on a surface, and the surface obtainable by this method, as defined in any of the accompanying claims.

The invention therefore provides a method for depositing functional groups on a surface of an object by generating and maintaining a plasma, said method comprising the steps of:

a. bringing the object surface close to or in a space between a first and a second electrode, an atmosphere being present between the two electrodes,
b. applying an alternating voltage to the first and the second electrode for generating and maintaining a plasma in the volumetric space between the two electrodes, the voltage alternating between a positive voltage for the first electrode and a zero voltage for the second electrode, and a zero voltage for the first electrode and a negative voltage for the second electrode, and
c. depositing a plurality of functional groups on at least a part of the surface of the object, whereby the atmosphere between the two electrodes comprises a multi-functional hyperbranched compound which is a polymer based on $AB_m$ type monomers, or a derivative of such polymer, whereby m is at least 2 and possibly 3, 4 or more, and A and B are two reactive functional groups selected such that group A is able to react at least m times with group B, and whereby the hyperbranched compound is having a degree of branching (DB) in the range of 10.0-99.9%.

We have found that the method according to the present invention is able to achieve a very high density of functional groups on the treated surface with a much smaller coating thickness, and the functional groups are much stronger bound to the surface as compared to techniques not using a plasma-treatment. These properties are able to bring much more improved surface properties as compared to the techniques which so far have been known in the art. The surfaces treated according to the present invention enjoy a much greater improvement in terms of printability, adhesion properties, paintability, particular mechanical properties such as impact resistance, scratch resistance and/or stain resistance, as compared to the treatment techniques previously known in the art. The method according to the present invention is also able to strongly functionalize surfaces which are known for their chemical inertness, such as the surfaces of polyolefin objects, for instance polypropylene or polyethylene films.

In another embodiment, the invention provides for an object having at least one surface obtainable by the method according to the present invention. The surface plasma-treated according to the present invention enjoys a very high density of functional groups, much higher than what is obtainable by other plasma techniques not using the introduction of multi-functional hyperbranched compounds into the plasma. The functional groups on the surface according to the present invention are also much stronger bound to the surface as compared to what is obtainable by other treatment methods, not involving plasma techniques, because the molecule fractions which contain the functional groups enjoy a higher density of attachment points to the surface as compared to the techniques known in the art.

The surfaces according to the present invention thus enjoy a high density of functional groups together with a stronger degree of bonding of those functional groups with the surface material. The result is that the surface maintains its high density of functionality longer under more severe conditions, such as under the more severe conditions of high temperature, high or low humidity, low pressure, high acidity, high alkalinity, high wear, high shear, high abrasion, higher impact, high exposure to mechanical forces such as high tear forces.

In another embodiment, the invention provides for an object having at least one surface obtainable by the method according to the present invention. The applicants have found that the surfaces which are plasma treated with the method according to the present invention are unique in the sense that they are characterised by a high density of functional groups on the surface, and also by a high number of attachment points connecting these functional groups to the surface, such that the surface properties are characterised by a higher stability, especially when the surface may be exposed to UV radiation, to weathering, or to chemical attack, such as by acids or bases, potent solvents, corrosive or aggressive environments, and the like. If the surface property which is improved is adhesion, the improved adhesion property of the treated surface may for instance be demonstrated by a peel test.

BRIEF DESCRIPTION OF THE DRAWINGS

FIG. 1 shows one possible structure of a multifunctional hyperbranched compound according to the present invention.

DETAILED DESCRIPTION

The present invention makes use of multi-functional hyperbranched compounds. These are oligomer or polymer compounds with a highly branched three-dimensional structure without many cross-links, preferably without any cross-links. The hyperbranched molecules are often characterized by a so-called dendritic or tree-like structure. They have a densely branched structure with a large number of end-groups. They may have evenly spread branched star-like topologies or may have imperfectly branched or irregular structures.

These hyperbranched compounds are typically synthesized from $AB_m$ type monomers, containing one reactive group A of one type and m reactive groups B of another type. When each group B is able to react with one group A, the polymerization of the $AB_m$ type monomers leads to highly branched three dimensional polymer structures, and because each branch ends with a functional group B, the resulting hyperbranched compound is also multi-functional.

Such multi-functional hyperbranched structures are discussed for instance in A. Sunder, J. Heinemann and H. Frey, "Controlling the Growth of Polymer Trees: Concepts and Perspectives for Hyperbranched Polymers", Chem. Eur. J., 2000, 6, No. 14, pp 2499-2506 and in D, Hölter, A. Burgath and H. Frey, "Degree of branching in hyperbranched polymers", Acta Polymer., 1997, 48, pp 30-35. The present invention uses the definition of the degree of branching (DB) as developed in the 1997 article by Hölter, Burgath and Frey. Further information about hyperbranched polymers may be found in C. Gao, D. Yan, "Hyperbranched polymers: from synthesis to applications, Progress in Polymer Science 29 (2004), Elsevier, pp. 183-275. US 2011/0028603 A1 describes the use of hyperbranched polymers and oligomers comprising terminal amino groups as curing agents for epoxy resins.

These multifunctional hyperbranched molecules are already known. EP 2277934 discloses that highly functional, highly branched or hyperbranched polyesters may be used as bonding agent in a number of conventional coating techniques. US 2002/151655 discloses that some of these compounds may be used as amphiphilic block copolymer additives to polymer compositions in order to increase the surface energy of polymeric substrates. U.S. Pat. No. 6,114,489 discloses their use in powder coating compositions.

The applicants have now found that these hyperbranched compounds may also be suitable for use in a single step plasma treatment of surfaces, with widely beneficial effects on the surface properties, obtainable with a simple treatment process.

Plasma is a fourth state or matter, besides solid, liquid and gas. Plasma is loosely described as an electrically neutral medium of positive and negative particles, with the overall charge of the plasma being roughly zero. It is important to note that although the ionised particles are unbound, these particles are not 'free'. When the charges move they generate electrical currents with magnetic fields, and as a result, they are affected by each other's fields. This governs their collective behaviour with many degrees of freedom.

Plasma deposition techniques have been quite widely used for the deposition of polymeric coatings onto a range of surfaces. This technique is recognised as being a clean, dry technique that generates little waste compared to conventional wet chemical methods. Using this method, plasmas are generated from typically small organic molecules, which are subjected to an ionising electrical field. When this is done in the presence of a substrate, the ions, radicals and excited molecules of the compound in the plasma polymerise in the gas phase and react with a growing polymer film on the substrate. Conventional polymer synthesis tends to produce structures containing repeat units which bear a strong resemblance to the monomer species, whereas a polymer network generated using a plasma can be extremely complex.

Suitable plasmas for use in the method of the invention include non-equilibrium plasmas such as those generated by radiofrequencies (Rf), microwaves or direct current (DC). They may operate at atmospheric or sub-atmospheric pressures as are known in the art.

The dissipated power of the plasma may suitably be set at a level of up to 50 $W/cm^2$, but may readily be as low as 0.1 $W/cm^2$. The applicants prefer to work at a level below 30 $W/cm^2$, preferably at most 20 $W/cm^2$, more preferably at most 15 $W/cm^2$, even more preferably at most 10 $W/cm^2$, and most preferably in the range of 0.2 to 0.8 $W/cm^2$. This brings the advantage that there is less risk for damaging the equipment. In terms of frequencies, the applicants like to work in the range of 1-100 kHz, and they have found that the entire range is workable.

Suitable conditions may include pulsed or continuous fields. In pulsed fields, the pulses may be applied in a sequence which yields very low average powers, for example of less than 10 $W/cm^2$ and preferably of less than 1 $W/cm^2$.

Examples of such sequences are those in which the power is on for 20 μs and off for from 10000 μs to 20000 μs.

The plasma is preferentially generated by alternating current (AC) excitation, applying voltages up to 100 kV, typically at high frequencies, such as at least 5 kHz. In a plasma jet, a pulsed electric arc may be generated by means of high voltage discharge (5-15 kV, 10-100 kHz). A preferred high-frequency alternating voltage in the range of 10 to 30 kV, with an optional small superimposed direct voltage component to stabilize the discharge, may also be applied.

The electrical fields are suitably applied for a period sufficient to give the desired coating. This may be very low, such as at least 0.1 seconds and possibly not more than 30 seconds. In other circumstances, this period may be longer, such as from 30 seconds to 20 minutes, preferably from 2 to 15 minutes, depending for instance upon the nature of the compound and the substrate.

In an embodiment, the method according to the present invention uses an atmospheric plasma. Plasma processing at atmospheric pressure is a relatively new technology—the first reports date from 1990—and it offers many advantages over vacuum plasma technology, including the ability to work in-line, the significantly lower process costs and the compatibility with virtually any type of substrate material.

A wide variety of surface properties may be affected by the plasma treatment of the present invention. In an embodiment, the method according to the present invention is employed for improving at least one of the surface properties selected from the group consisting of adhesion, printability, paintability, mechanical properties, impact resistance, scratch resistance, stain resistance, antibacterial properties, hydrophilic properties, superhydrophilic properties, hydrophobic properties, superhydrophobic properties, antifouling properties, antifogging properties, tribological properties, optical properties, electronic properties, magnetic properties, and mixtures thereof.

In another embodiment, the multi-functional hyperbranched compound in the method according to the present invention contains at least 2 functional groups per compound molecule, preferably at least 3, more preferably at least 4, even more preferably at least 5, yet more preferably at least 10, preferably at least 15, more preferably at least 20, even more preferably at least 25, yet more preferably at least 30, preferably at least 40 functional groups per compound molecule, and optionally at most 500 functional groups per compound molecule, preferably at most 400, more preferably at most 300, even more preferably at most 200, yet more preferably at most 150, preferably at most 120, more preferably at most 100 functional groups per compound molecule, the functional groups being identical or different. The applicants prefer to have a high number of functional groups per molecule in the multi-functional hyperbranched compound, in order to achieve a higher density of the functional groups on the treated surface. However, the higher the number of functional groups in the molecule, the higher the molecular weight of the molecules. Compounds having too high a molecular weight are more difficult to dissolve in a liquid carrier, and thus are more difficult to inject as liquids having high compound concentrations. When the compound is itself a liquid, a higher molecular weight typically brings a higher liquid viscosity, such that the liquid is more difficult to inject into the plasma. When necessary, a solvent may be used, but this may require an adaptation of the application parameters. Such techniques may expand the molecular weight range of applicable compounds.

In an embodiment of the present invention, the functional groups in the multi-functional hyperbranched compound are selected from the groups which are considered functional in the context of organic chemistry, preferably the functional groups being selected from the group consisting of nitril, silyl, siloxane, ammonium, phosphate, phosphino, phosphono, aloxide, alkyl, alkenyl, alkynyl, phenyl, benzyl, aldehyde, hydroperoxy, peroxy, hemiacetal, acetal, orthoester, orthocarbonate ester, azide, cyanate, isocyanate, nitrate, nitro, nitroso, thiocyanate, isothiocyanate, carbanothioyl, vinyl, vinylidene, halide, in particular bromide, chloride, iodide or fluoride, hydroxyl, carbonyl, thiol, sulphide, disulphide, sulphone, sulphinic, sulphoxide, acid, epoxy, carboxylic acid, amine, imine, amide, hydrazine, nitrate, nitrite, amine oxide, carbonyl, acrylate, methacrylate, amino, ester, ether, thio-ether, organometallic and isocyanate groups.

The multi-functional hyperbranched compound according to the present invention has a degree of branching (DB) in the range of 10.0-99.9%, preferably at least 20.0%, more preferably at least 30.0%, even more preferably at least 37.0%, yet more preferably at least 40.0%, preferably at least 45.0%, more preferably at least 50.0% and optionally at most 99.0%, preferably at most 97%, more preferably at most 95%, even more preferably at most 90%, yet more preferably at most 85%, preferably at most 80%, more preferably at most 75%, even more preferably at most 70%, yet more preferably at most 65%, and more preferably at most 60%. The applicants have found that with the hyperbranched compounds according to the invention, unlike within some other families of organic compounds, a higher degree of branching may provide for the same molecular weight a lower viscosity of the compound as a liquid, and also a higher solubility of the compound in a liquid precursor or carrier.

In an embodiment, the multi-functional hyperbranched compound according to the present invention has a molecular weight of at least 300 dalton, preferably at least 500 dalton, more preferably at least 800 dalton, even more preferably at least 1000 dalton, yet more preferably at least 2000 dalton, preferably at least 3000 dalton, more preferably at least 4000 dalton, even more preferably at least 5000 dalton, yet more preferably at least 7000 dalton, preferably at least 10,000 dalton, more preferably at least 50,000 dalton, even more preferably at least 100,000 dalton, yet more preferably at least 500,000 dalton, and optionally at most $100\times10^6$ dalton, preferably at most 50 or only $20\times10^6$ dalton, more preferably at most 10, 5 or only $2\times10^6$ dalton, even more preferably at most 500,000 dalton, and yet more preferably at most 100,000 dalton.

In another embodiment, the multi-functional hyperbranched compound according to the present invention is selected from the group consisting of polyesters, polyester amides, polyurethanes, poly amides, poly(amino ethers), poly(amino amines), polyarylenes, poly(phenylene vinylenes), polyanilines. Examples of suitable commercially available compounds are those offered by the company DSM resins under the Hybrane® tradename, such as the Hybrane® hyperbranched polyester-amides.

In embodiment of the method according to the present invention, the multi-functional hyperbranched compound is present as a gas or as a liquid in the form of an aerosol, the aerosol preferably having an average particle size of 1-1000 nm, preferably at least 5 nm, more preferably at least 10 nm, even more preferably at least 20 nm, yet more preferably at least 30 nm, preferably at least 40 nm, more preferably at least 50 nm, and optionally at most 600 nm, preferably at most 400 nm, more preferably at most 200 nm, even more preferably at most 150 nm and yet more preferably at most 100 nm. The applicants have found that this form of presence is very convenient to work with, is simple to obtain and to process, and allows for an overall simple single-step treatment process to achieve the desired results in terms of functional group density and surface properties which remain stable over time.

In embodiment of the method according to the present invention, the multi-functional hyperbranched compound is injected into the plasma.

In an embodiment of the method according to the present invention whereby the compound is injected into the plasma, the method comprises the injection of a solution containing the multi-functional hyperbranched compound dispersed and/or dissolved into a liquid precursor, preferably the liquid precursor being selected from the group consisting of organic, hybrid, and sol-gel precursors, and mixtures thereof. This brings the advantage that the liquid properties, such as viscosity, may be adapted to the equipment which is used, yet may be used for a wide variety of multi-functional hyperbranched compounds. This embodiment thus brings a wide versatility to the method of the present invention.

In an embodiment of the method according to the present invention using a liquid precursor, also a reactive precursor is deposited, which preferably is selected from the group consisting of a hydrocarbon, a fluorinated hydrocarbon and an organometallic compound or a combination thereof.

In the embodiment of the method according to the present invention wherein the multi-functional hyperbranched compound dispersed and/or dissolved into a liquid precursor, the solution or dispersion containing the multi-functional hyperbranched compound has a viscosity at 20° C. of at most 150 centipoise (cP), preferably at most 100 cP, more preferably at most 50 cP, even more preferably at most 20 cP and yet more preferably at most 10 cP. The applicants prefer a lower viscosity because this allows to keep the method simple, yet allows for a high treatment rate and thus a high density of functional groups obtainable within a relatively short treatment time.

In another embodiment of the present invention, the method comprises, before introducing the sample into the space between the first and the second electrode, the additional step of applying a solution containing the multi-functional hyperbranched compound onto a surface of the sample. This additional feature may be referred to as "plasma post-curing". It brings the advantage of allowing to achieve a yet higher functional group density as with the method only having the multi-functional hyperbranched compound in the atmosphere between the electrodes, which may be even more important multi-functional hyperbranched compound having a high molecular weight.

In an embodiment of this method according to the present invention, the step of applying the solution containing the multi-functional hyperbranched compound onto the sample surface is selected from the group consisting of patterning or spreading out of the solution followed by drying, adsorption and/or covalent linking with or without making use of spacer molecules.

In the embodiment of the method according to the present invention comprising the step of applying the solution containing the multi-functional hyperbranched compound onto the sample surface, the solution containing the multi-functional hyperbranched compound which is applied onto the surface of the sample may have a relatively high viscosity. However, the applicants prefer that the solution which is applied has a viscosity at 20° C. of at most 10000 centiPoise (cP), preferably at most 5000 cP, more preferably at most 1000 cP.

Regardless whether the method according to the present invention uses injection of a liquid solution or dispersion into the plasma, and/or the application of a solution or dispersion onto the surface before the plasma treatment, the applicants prefer that at least one of the solutions containing the multi-functional hyperbranched compound has a viscosity at 20° C. of at least 0.1 cP, preferably at least 0.3 cP, more preferably at least 0.5 cP. Even more preferably, all of the solutions containing the multi-functional hyperbranched compound have this viscosity.

In an embodiment of the present invention, the multi-functional hyperbranched compound is administered to the afterglow of the plasma. The applicants have found that this technique allows for an easier treatment of surfaces of objects which are more difficult to bring into the space between the electrodes, for example because of the thickness or the shape of the object. This technique is found to be very suitable for treatment of surfaces of irregularly shaped three-dimensional objects, and even for the treatment of convex surfaces and may be the more suitable method for the treatment of concave surfaces.

In another embodiment of the method according to the present invention, the atmosphere between the two electrodes comprises at least one compound selected from helium, argon, nitrogen, air, hydrogen, oxygen, sulphur hexafluoride (SF6), carbon tetrachloride (CCl4), carbon tetrafluoride (CF4), carbon dioxide, ammonium, a C1-C4 alkane, such as methane, ethane, propane, butane, isobutane, acetylene, ethylene, propylene, ethylene oxide, nitrogen oxide, such as NO, $NO_2$ and $N_2O$, fluoroethylene, fluoropropylene, hexafluoropropylene, tetrafluoroethylene, water, ozone and mixtures thereof.

The applicants have found that the method according to the present invention may be applied to a wide variety of substrates. In an embodiment of the method according to the present invention, the treated object comprises at least one material selected from the group consisting of paper, glass, cardboard, wood, metal, ceramic and plastic materials, such as polymeric materials, woven and non-woven fibres, natural fibres, synthetic fibres, and natural and synthetic powders.

In another embodiment of the method according to the present invention, the electrodes are cooled to a temperature from 0° C. to 200° C., preferably at least 20° C., more preferably at least 23° C., even more preferably at least 30° C., yet more preferably at least 40° C., and optionally at most 120° C., preferably at most 100° C.

In another embodiment of the method according to the present invention, the pressure of the atmosphere between the two electrodes is at least 5×10−3 millibar absolute, preferably at least 0.010 millibar absolute, more preferably at least 0.10 millibar absolute, even more preferably at least 1.0 millibar absolute, yet more preferably at least 10.0 millibar absolute, preferably at least 100 millibar absolute, more preferably at least −0.5 bar gauge, even more preferably at least −0.6 bar gauge, yet more preferably at least −0.2 bar gauge, preferably at least −0.1 bar gauge, more preferably at least −0.05 bar gauge, yet more preferably about atmospheric, and optionally at most 2 bar gauge, preferably at most 1.5 bar gauge, more preferably at most 1.3 bar gauge, even more preferably at most 1.2 bar gauge, yet more preferably at most 1.10 bar gauge, more preferably at most 1.05 bar gauge.

In another embodiment of the method according to the present invention, by the treatment a coating is deposited having a thickness of at most 50 μm, preferably at most 25 μm, more preferably at most 10 μm, even more preferably at most 5, 3, 2 or only 1.0 μm, preferably at most 500, 200 or only 100 nm, more preferably at most 70, 50 or only 40 nm, even more preferably at most 30, 20 or only 10 nm, and yet more preferably at most 7, 5, 3 or even at most 1 nm.

In another embodiment of the method according to the present invention, the treatment time of exposing the surface of the sample to the plasma is at most 300 seconds, preferably at most 120 seconds, more preferably at most 90 or only 60 seconds, even more preferably at most 30, 20 or only 10 seconds, and yet more preferably at most 5 or 2 seconds, or at most only 1 second.

In another embodiment, the method according to the present invention further comprises a step selected from gluing the plasma-treated surface to a second surface, printing the plasma-treated surface, painting the plasma-treated surface, laminating the plasma-treated surface, and combinations thereof.

In another embodiment of the method according to the present invention, the object is a polymer film which is, at least partially and at least on one side, plasma-treated by depositing the plurality of functional groups on at least part of the surface of the object, and which film is, optionally after being printed, painted or laminated on at least one side, attached to a second object.

In an embodiment of the present invention wherein the object is a polymer film, it is the plasma-treated surface of the film which is attached to the second object. Alternatively it is the surface of the film which is not plasma-treated which is attached to the second object.

In another embodiment, the invention provides for an object having at least one surface obtainable by the method according to the present invention. The object according to the present invention may be selected from the group consisting of a photovoltaic cell, a laminated panel, a metal profile, a polymeric profile, a laminated film, a composite of at least one metal and at least one polymer, a composite of at least one ceramic material and at least one polymer, a glass panel, a tape, a pressure sensitive adhesive tape, a laminated paper, a packaging material, a fibre, and an engineering part

EXAMPLES

Hyperbranched bis-MPA polyester-64-hydroxyl (generation 4, ≥97%, CAS 326794-48-3) was purchased from Sigma-Aldrich. This hyperbranched product is formed by the step growth addition by esterification of 2,2-bis(hydroxymethyl)propanoic acid onto a starting polyol having 4 hydroxyl functions, and this up to 4 generations such that the hyperbranched product comprises about 64 hydroxyl functions per molecule. The product may be characterised by the following specification:

Name: Hyperbranched bis-MPA polyester-64-hydroxyl, generation 4, ≥97%

CAS number: 326794-48-3

Mol. weight: theoretically 7323.32, actually approximately 7323 g/mole

Conforming to structure of FIG. 1 by IR or by $H^{-1}$NMR.

Elemental analysis: 49.1%-52.1% carbon

A precursor solution was prepared by incorporating 1 gram of this hyperbranched compound into 9 grams of 2-hydroxyethylacrylate. The solution was homogenized at room temperature under mechanical stirring for 30 minutes.

The plasma treatment uses the technique of Dielectric Barrier Discharges (DBD) at atmospheric pressure, as explained in more detail in WO 2009/037331 and the FIG. 1 in that document. The DBD are produced between two parallel stainless steel electrodes, both covered with a 3 mm insulating glass plate. The gap width between the electrodes was set at 2 mm to ensure a stable plasma operation.

As the sample to be treated, a stainless steel plate of 0.5 mm thick and measuring 8 by 8 cm was placed on the lower electrode. The sample was submitted to a nitrogen plasma at a flow of 20 Nlm (normal liter per minute) and the precursor solution was injected under the form of an aerosol into the plasma. The aerosol was created by using an atomizer with a nozzle with a diameter of 0.4 mm through which a flow of nitrogen of 3 normal liter per minute was blown. The dissipated power of the plasma was set at 0.5 $W.cm^{-2}$ and the frequency at 1.5 kHz. The coating deposition was carried out during 27 seconds.

The surface tension parameters of the treated sample were investigated using static contact angle measurements according to the model developed by Owens and Wendt on a Data Physics Instrument. Two liquids were used in the measurements, i.e. diiodomethane and water. The surface tension ($\sigma_s$) was calculated based on the contact angles of the liquid sample formed with diiodomethane and water. According to the model of Owens and Wendt, the surface tension can be split in a polar and a disperse fraction, which may be calculated from these contact angles.

$$\sigma_s=\sigma_s^P+\sigma_s^D$$

wherein $\sigma_s$: the surface tension of a solid material $\sigma_s^P$: the polar fraction of the surface tension of a solid material $\sigma_s^D$: the disperse fraction of the surface tension of a solid material The results in terms of surface energy parameters as shown in Table 1 were obtained for the untreated stainless steel substrate and for the plasma treated sample. CA in the Table stands for contact angle, which is expressed in degrees of which it takes 360° for a full circle, and the surface tensions are given in $dynes.cm^{-1}$. The results show a clearly increased surface tension of the plasma treated sample compared to the untreated sample.

TABLE 1

| Sample | CA $H_2O$ | CA $CH_2I_2$ | $\sigma_s^P$ | $\sigma_s^D$ | $\sigma_s$ |
|---|---|---|---|---|---|
| untreated | 71.5 | 45.8 | 8.5 | 33.9 | 42.4 |
| plasma treated | 20.7 | 29.4 | 33.9 | 38.3 | 72.2 |

Having now fully described this invention, it will be appreciated by those skilled in the art that the invention can be performed within a wide range of parameters within what is claimed, without departing from the spirit and scope of the invention. As understood by those of skill in the art, the overall invention, as defined by the claims, encompasses other preferred embodiments not specifically enumerated herein.

The invention claimed is:

1. A method for depositing functional groups on a surface of an object by generating and maintaining a plasma, said method comprising the steps of:

a. bringing the object surface close to or in a space between a first and a second electrode, an atmosphere being present between the two electrodes, b. applying an alternating voltage to the first and the second electrode for generating and maintaining a plasma in the volumetric space between the two electrodes, the voltage alternating between a positive voltage for the first electrode and a zero voltage for the second electrode, and a zero voltage for the first electrode and a negative voltage for the second electrode, and c. depositing a plurality of functional groups on at least part of the surface of the object, wherein the atmosphere between the two electrodes comprises a multi-functional hyperbranched compound which is selected from a polymer based on $AB_m$ type monomers, a derivative of such polymer, or mixtures thereof, m is at least 2, and A and B have reactive functional groups selected such that group A is reacted at least m times with group B, and the hyperbranched compound has a degree of branching (DB) in the range of 10.0-99.9%.

2. The method according to claim 1, wherein the multi-functional hyperbranched compound contains at least 2 functional groups per compound molecule and optionally at most 500 functional groups per compound molecule.

3. The method according to claim 2, wherein the functional groups are identical.

4. The method according to claim 2, wherein the functional groups are different.

5. The method according to claim 1, wherein the multi-functional hyperbranched compound is injected into the plasma.

6. The method according to claim 5, wherein the multi-functional hyperbranched compound is injected in a form selected from a first dispersion in a liquid precursor, a first solution in a liquid precursor, or combinations thereof.

7. The method according to claim 6, wherein the liquid precursor is selected from the group consisting of organic precursors, hybrid precursors, sol-gel precursors, and mixtures thereof.

8. The method according to claim 6, wherein the first solution or the first dispersion containing the multi-functional hyperbranched compound has a viscosity of at least 0.1 cP.

9. The method according to claim 6, wherein the first solution or the first dispersion containing the multi-functional hyperbranched compound has a viscosity at 20° C. of at most 150 centipoise (cP).

10. The method according to claim 1 further comprising, before introducing the sample into the space between the first and the second electrode, the step of applying a second solution containing the multi-functional hyperbranched compound onto a surface of the sample.

11. The method according to claim 10, wherein the step of applying the second solution containing the multi-functional hyperbranched compound onto the sample surface is selected from the group consisting of patterning the solution, spreading out the solution, and combinations thereof, followed by drying, adsorption and covalent linking.

12. The method according to claim 11, wherein the covalent linking does not use spacer molecules.

13. The method according to claim 11, wherein the covalent linking uses spacer molecules.

14. The method according to claim 10, wherein the second solution containing the multi-functional hyperbranched compound which is applied onto the surface of the sample has a viscosity at 20° C. of at most 10000 cP.

15. The method according to claim 10, wherein the second solution containing the multi-functional hyperbranched compound has a viscosity of at least 0.1 cP.

16. The method according to claim 1, wherein the multi-functional hyperbranched compound is administered to the afterglow of the plasma.

17. The method according to claim 1, wherein the object comprises at least one material selected from the group consisting of paper, glass, cardboard, wood, metal, ceramic and plastic materials.

18. The method according to claim 1, wherein the treatment time of exposing the surface of the sample to the plasma is at most 300 seconds.

19. The method according to claim 1 further comprising a step selected from gluing the plasma-treated surface to a second surface, printing the plasma-treated surface, painting the plasma-treated surface, laminating the plasma-treated surface or combinations thereof.

20. The method according to claim 1, wherein the object is a polymer film which is, at least partially and at least on one side, plasma-treated by depositing the plurality of functional groups on at least part of the surface of the object, and which film is attached to a second object.

21. The method according to claim 1, wherein the polymer film is attached to the second object after being subjected to a treatment which is selected from being printed, being painted, being laminated, or combinations thereof, on at least one side.

* * * * *